US007348929B2

(12) United States Patent
Phelan et al.

(10) Patent No.: US 7,348,929 B2
(45) Date of Patent: Mar. 25, 2008

(54) PHASED ARRAY ANTENNA WITH SUBARRAY LATTICES FORMING SUBSTANTIALLY RECTANGULAR APERTURE

(75) Inventors: Harry R. Phelan, Palm Bay, FL (US); Mark L. Goldstein, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 271 days.

(21) Appl. No.: 11/222,445

(22) Filed: Sep. 8, 2005

(65) Prior Publication Data

US 2007/0063898 A1 Mar. 22, 2007

(51) Int. Cl.
*H01Q 21/00* (2006.01)

(52) U.S. Cl. ..... 343/844; 343/853; 343/893

(58) Field of Classification Search ..... 343/844, 343/853, 893; 342/372
See application file for complete search history.

(56) References Cited

U.S. PATENT DOCUMENTS

| | | | | |
|---|---|---|---|---|
| 5,422,647 | A * | 6/1995 | Hirshfield et al. | 342/354 |
| 5,838,284 | A * | 11/1998 | Dougherty | 343/893 |
| 6,456,244 | B1 | 9/2002 | Goldstein et al. | 343/700 |
| 6,529,166 | B2 * | 3/2003 | Kanamaluru | 343/700 MS |
| 6,646,621 | B1 | 11/2003 | Phelan et al. | 343/895 |
| 6,842,157 | B2 | 1/2005 | Phelan et al. | 343/893 |

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

A phased array antenna includes a plurality of subarray lattices connected together in a linear configuration and forming a substantially rectangular aperture. Each subarray lattice is clocked progressively to obtain an aperiodic aperture and reduce grating lobes.

21 Claims, 15 Drawing Sheets

NEC MOMENT METHOD MODEL OF 64 ACTIVE CROSSED-DIPOLE ELEMENTS AT 14.4 GHz
0.700" ELEMENT SPACING (2318 SEGMENTS, 610 WIRES )
DIPOLE:0.386" LENGTH,0.0966" HORIZONTAL SPAN,
0.0966" VERTICAL SPAN, 0.185" FEED HEIGHT ABOVE GROUND 96.2% SLL COMPLIANCE/ 0.013 dB PEAK BEAM SHAPE RIPPLE
FOR THE 30 RANDOM MAIN BEAM LOCATIONS SHOWN BELOW 96.6% SLL COMPLIANCE/ 0.024 dB PEAK BEAM SHAPE RIPPLE
FOR THE 30 RANDOM MAIN BEAM LOCATIONS

PHASED ARRAY ANTENNA WITH SUBARRAY LATTICES FORMING SUBSTANTIALLY RECTANGULAR APERTURE

FIELD OF THE INVENTION

The present invention relates to the field of phased array antennae, and more particularly, this invention relates to a phased array antennae having a plurality of subarray lattices.

BACKGROUND OF THE INVENTION

Low cost phased array antennae are required on naval ships, land-based radar stations and similar areas. Traditional phased array antennae using periodic lattices and transmit/receive modules are prohibitive in cost. When an antenna is designed for use with short wavelengths, the transmit/receive modules are bulky and cannot be positioned between antenna elements. Also, advanced radar designs require low sidelobe architecture, and in some instances, many subarrays are desired.

One prior art approach uses a traditional periodic array orientation of subarrays. It has been found that this type of prior art phased array antenna produces grating lobes. This is especially true at higher frequency applications, such as the X-band and Ku-band. Even lower frequency applications than the UHF, L-band and S-band have been found to produce grating lobes.

Commonly assigned U.S. Pat. No. 6,456,244, the disclosure which is hereby incorporated by reference in its entirety, discloses a phased array antenna that includes a plurality of subarray lattices arranged in an aperiodic array lattice. Each subarray lattice includes a plurality of antenna elements arranged in an aperiodic configuration on a multilayer circuit board. Typically, the elements are arranged in a spiral configuration. This type of arrangement is a low-cost approach for reducing sidelobes and grating lobes. In one aspect, it is similar to other periodic and aperiodic arrays that are typically designed with a circular or square overall aperture shape. Some phased array antenna have been designed with a periodic triangular grid and circular aperture with a nominal 8×8 degree symmetrical beam.

This type of phased array antenna as described is not as advantageous if a transmit beam with a different aspect ratio is required, such as greater in azimuth than elevation. For example, a phased array antenna could require the same width, but three or four times the height. This could be accomplished by increasing the number of elements by 4:1. This would cut the power for each element by 4:1, however, and the resulting array costs would increase by at least 3:1, increasing the cost, size and weight of the overall phased array antenna. Periodic arrays are typically forced to this configuration in conventional designs because the element spacing is limited to nearly one-half wavelength. It would be advantageous if aperiodic grid techniques could be used to solve these problems.

SUMMARY OF THE INVENTION

In view of the foregoing background, it is therefore an object of the present invention to provide an aperiodic phased array antenna that has an aperture configured to meet a beam shape with an aspect ratio of greater height or width.

In accordance with one aspect of the present invention, a phased array antenna includes a plurality of subarray lattices connected together in a linear configuration and forming a substantially rectangular aperture. Each subarray lattice is clocked progressively to obtain an aperiodic aperture and reduce grating lobes.

In one aspect, the aperture has a beam that is greater in azimuth than in elevation. The aperture has a beam that has about a 4:1 aspect ratio. The aperture also has a beam that is about two degrees in elevation by about eight degrees in azimuth. The phased array antenna can include four subarray lattices clocked progressively about 90 degrees. The aperture could also form eight beams, with each subarray lattice forming two beams simultaneously. Each subarray lattice can also be formed as a plurality of antenna elements arranged in an aperiodic configuration.

In another aspect, the antenna elements are spaced from each other greater than about one-half wavelength of a transmitted or received signal. The antenna elements in each subarray lattice can also be configured in a spiral or random matter, and can be formed substantially identical to each other.

In yet another aspect, the phased array antenna can include a circuit board with a plurality of antenna elements on the circuit board and arranged into a plurality of subarray lattices in a linear configuration forming the rectangular aperture. Electronic circuitry is supported by the circuit board and operatively connected to the antenna elements for amplifying, phase shifting and beam forming any transmitted and received signals. Each subarray lattice is clocked progressively to obtain an aperiodic aperture and reduce grating lobes. An antenna support member can support the circuit board. The circuit board can be formed as a multilayer circuit board, such as green tape layers.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
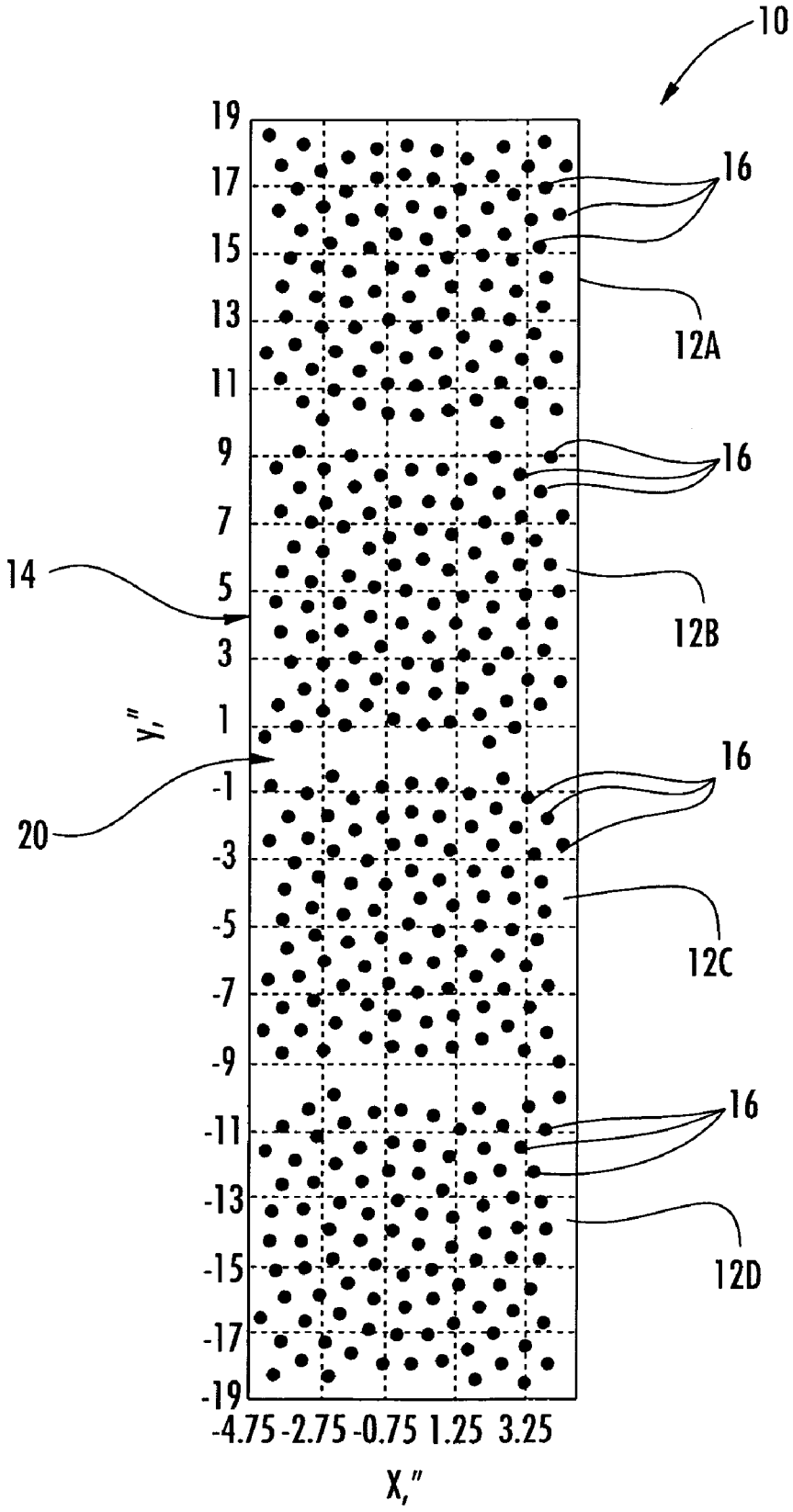
FIG. 1 is a plan view of the phased array antenna showing the linear configuration of the connected subarray lattices and forming a substantially rectangular aperture, in accordance with an example of the present invention.

Referring now to FIG. 1, a phased array antenna is shown at 10 and includes a plurality of subarray lattices 12A-D connected together in a linear configuration and forming a substantially rectangular aperture indicated at 14. Each subarray lattice 12A-D is clocked progressively to obtain an aperiodic aperture and reduce grating lobes. The aperture 14 has a beam that is greater in azimuth than in elevation, and the beam has about a four to one aspect ratio in one nonlimiting example, producing a two degree elevation by eight degree azimuth beam while obtaining other performance. As illustrated, the aperture is split into four vertical quadrants formed by the subarray lattices 12A-D, allowing formation of eight beams from the aperture in which each quadrant forms two beams simultaneously.

As illustrated four subarray lattices 12A-D are connected together and clocked progressively about ninety degrees to each other. Although four subarray lattices are illustrated, another number could be used depending on configuration, clocking, and other design functions. Each subarray lattice comprises a plurality of antenna elements 16 arranged in an aperiodic configuration. The antenna elements 16 in one non-limiting example are spaced from each together greater than about one-half wavelength of a transmitted or a received signal. The antenna elements 16 in each subarray lattice 12A-D can be configured in a spiral or random fashion and each subarray lattice can be formed substantially identical to each other as illustrated, or different. In the illustrated embodiment, the antenna elements 16 are arranged in a spiral configuration.

Figure 3:
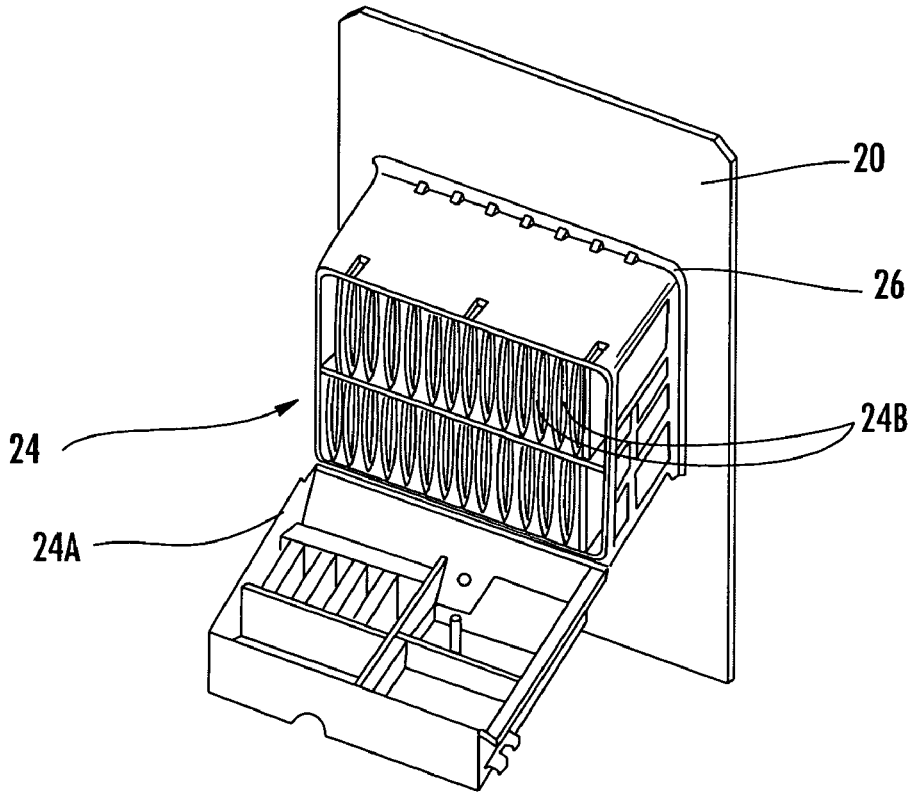
FIG. 3 is an isometric view of the phased array antenna showing the rear side of the circuit board and electronic circuitry supported by the circuit board, in accordance with an example of the present invention.

FIG. 1 further shows a circuit board indicated generally at 20 on which the antenna elements are positioned. FIG. 3 shows electronic circuitry indicated generally at 24, supported by the circuit board 20 and operatively connected to the antenna elements 16 for amplifying, phase shifting and beam forming any transmitted and received signals. The electronic circuitry 24 can be formed as an electronics chassis as illustrated and include various modules 24*a* and plug-in receptacles 24*b* as known to those skilled in the art. An antenna support member 26 can support the circuit board with the electronic circuitry 24. The circuit board and antenna elements can be formed by techniques similar to what is disclosed in commonly assigned U.S. Pat. No. 6,456,244.

Figure 2:
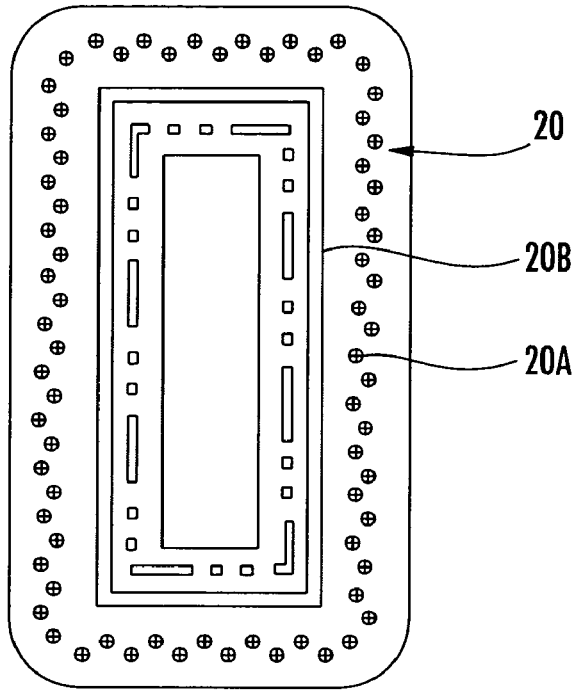
FIG. 2 is a front view of the phased array antenna showing the multilayer circuit board and plurality of antenna elements, in accordance with an example of the present invention.

FIG. 2 is a plan view showing the circuit board 20 with a number of mounting holes 20*a* that can receive fasteners for mounting the circuit board to an assembly that can include a radome. The rectangular outline 20*b* indicates the electronic circuitry 24 mounting area.

Figure 4:
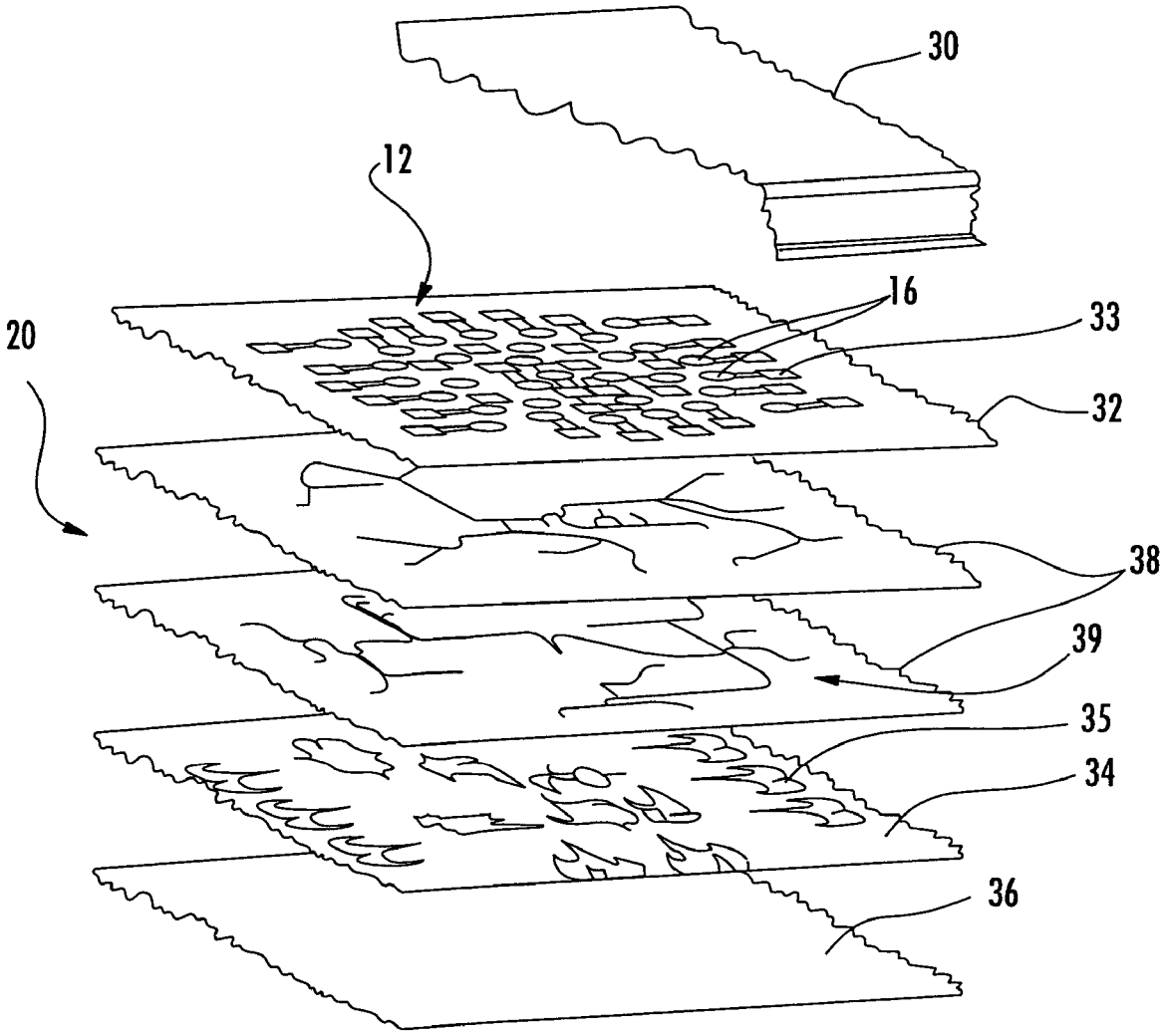
FIG. 4 is an exploded isometric view of an aperiodic subarray lattice formed on a multilayer printed wiring board (PWB) and showing different layers for supporting amplifier elements, a beam forming network, phase shifters and packaging components, in accordance with an example of the present invention.

In one aspect, the circuit board 20 can be formed as a multi-layer circuit board as shown in FIG. 4 and can be formed by green tape layers using the manufacturing techniques known to those skilled in the art.

Although the spiral configuration as illustrated is only one type of aperiodic configuration, it has been found adequate such that when a plurality of subarray lattices are configured in the aperiodic configuration for the phased array antenna 10 formed as a panel as shown in FIG. 1, the grating or side lobes are reduced adequately, such that the side lobes are significantly reduced to levels acceptable for SATCOM certification. The spacing of antenna elements 16 also is such that there is room for amplifiers and phase shifters between antenna elements. This is advantageous, and the aperiodic spacing is desirable when spacing is greater than one-half wavelength. Any shorter spacing could possibly create a situation where there is no room to place the LNA's (Low Noise Amplifiers), phase shifters, beam forming network circuit, and other circuit elements, as known to those skilled in the art. This type of configuration forms an adequate aperture for efficiency in operation.

Referring now to FIG. 4, there is shown a portion of the circuit board 20 and representative subarray lattice 12 used in a low-cost phased array architecture shown in FIG. 1. When used with the array panel configuration shown in FIG. 1, production cost is reduced. The multilayer printed circuit board 20 can include surface mount components, as is known to those skilled in the art. This architecture is scalable to higher and lower frequency bands.

A subarray lattice structure could include a radome 30 and the radiating elements positioned on the multilayer circuit board 20. A top layer 32 of the circuit board can include, for instance, amplifier elements 33, including low noise amplifiers (LNA) or other components. A lower layer 34 of the board could include, for instance, phase shifters, post amplification circuit elements with combiners, beam steering elements 35 or other components. A ground plane 36 could be included. A middle layer 38 (illustrated in this embodiment as two layers) can include a beam former network 39 with power combining and signal distribution. Other layers can include beam control components, filtering or other components, which can exist as combined on some layers or separate. The layers can be formed by techniques known to those skilled in the art, including the use of green tape layers. Mechanical packaging components could include basic power supplies, cooling circuits and packaging. Such a structure can then be placed in another support structure and form part of the lattice as a microstrip patch element.

The phased array antenna shown in FIG. 1 has about 384 elements in one nonlimiting example, and the antenna element 16 spacing in this exemplary aperiodic subarray lattice is about 0.87 inches, corresponding to about 1.13 wavelength in a nonlimiting example. FIG. 2 shows an antenna element 16 positioned on a board while FIG. 3 shows the electronics circuitry 24 as an electronics chassis positioned on the rear side of the circuit board and containing the different modules necessary for operating the phased array antenna.

Figure 5:
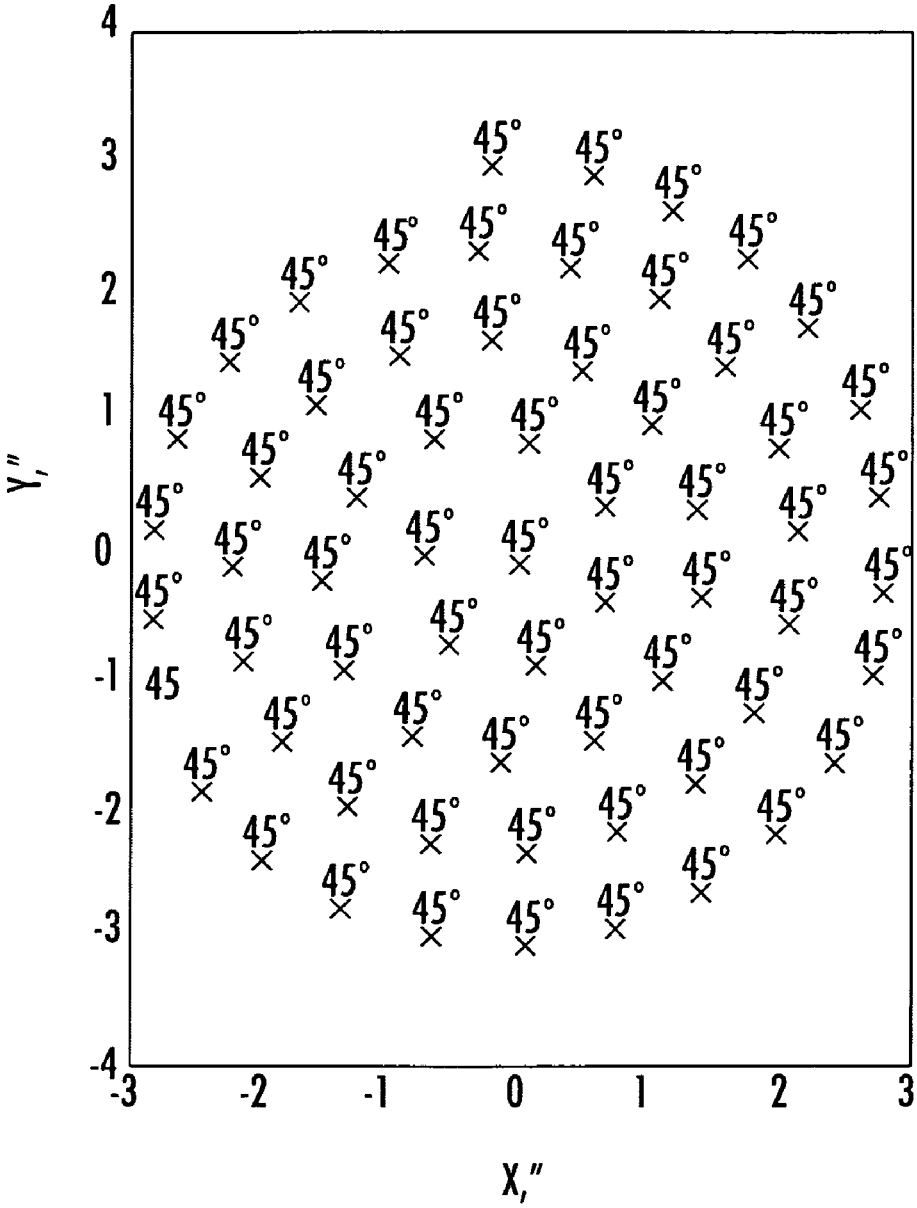
FIG. 5 is a graph showing an aperiodic spiral grid with an NEC moment model of 64 active cross-dipole elements and a grid scaled from an equivalent receiver element spacing, in accordance with an example of the present invention.

FIG. 5 shows the layout of an aperiodic array with a grid scaled from an equivalent receiver element spacing. The NEC moment method model of 64 active cross-dipole elements of 14.4 GHz is shown. The antenna element spacing is about 0.700 inches with 2,318 segments and 610 wires. The dipole is about 0.386 inches length and 0.0966 inches with horizontal span and 0.0966 inches vertical span and 0.185 inch feed-height above ground in this nonlimiting example.

Figure 6:
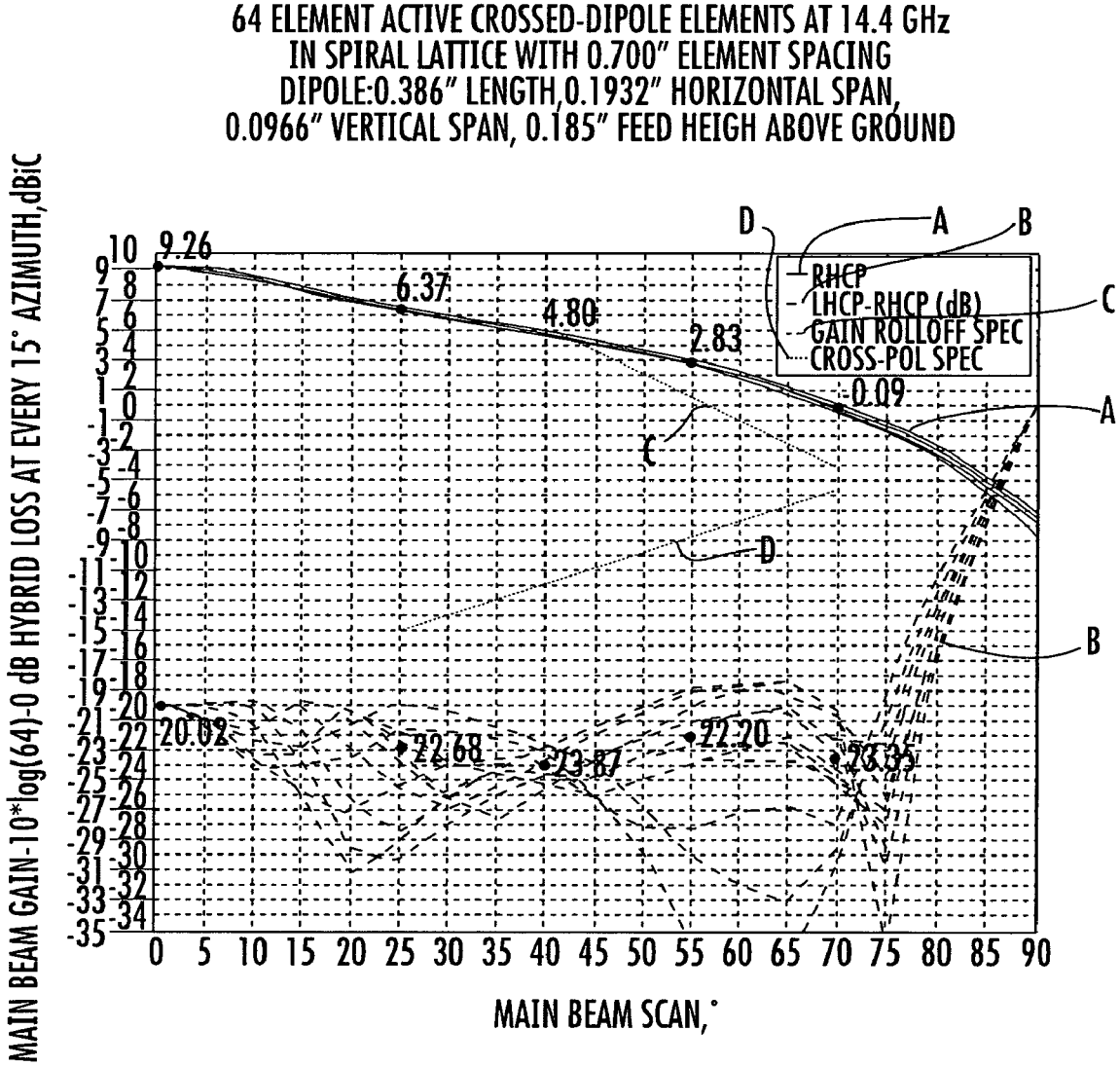
FIG. 6 is a graph showing an aperiodic grid element pattern with 64 active cross-dipole elements arranged in a spiral lattice at 14.4 GHz, in accordance with an example of the present invention.

FIG. 6 shows an aperiodic grid element pattern scaled from the receiver in which the element spacing is similar to that shown in FIG. 5, using a 384-element count as an aperiodic array. The gain at 0 scan=9.26 decibels with a gain at maximum scan of 55 degrees at about 2.83 decibels. The gain at 55 degrees of this aperiodic array is substantially equivalent to a periodic array and the gain of the aperiodic array is higher than the periodic array throughout the scan volume. The graph shows a 64 element active crossed-dipole elements at 14.4 GHz in a spiral lattice with 0.700 inches element spacing dipole with a 0.386 inch length, 0.1932 inch horizontal span, 0.096 inch vertical span, and 0.185 inch feed-height above ground.

Figure 7:
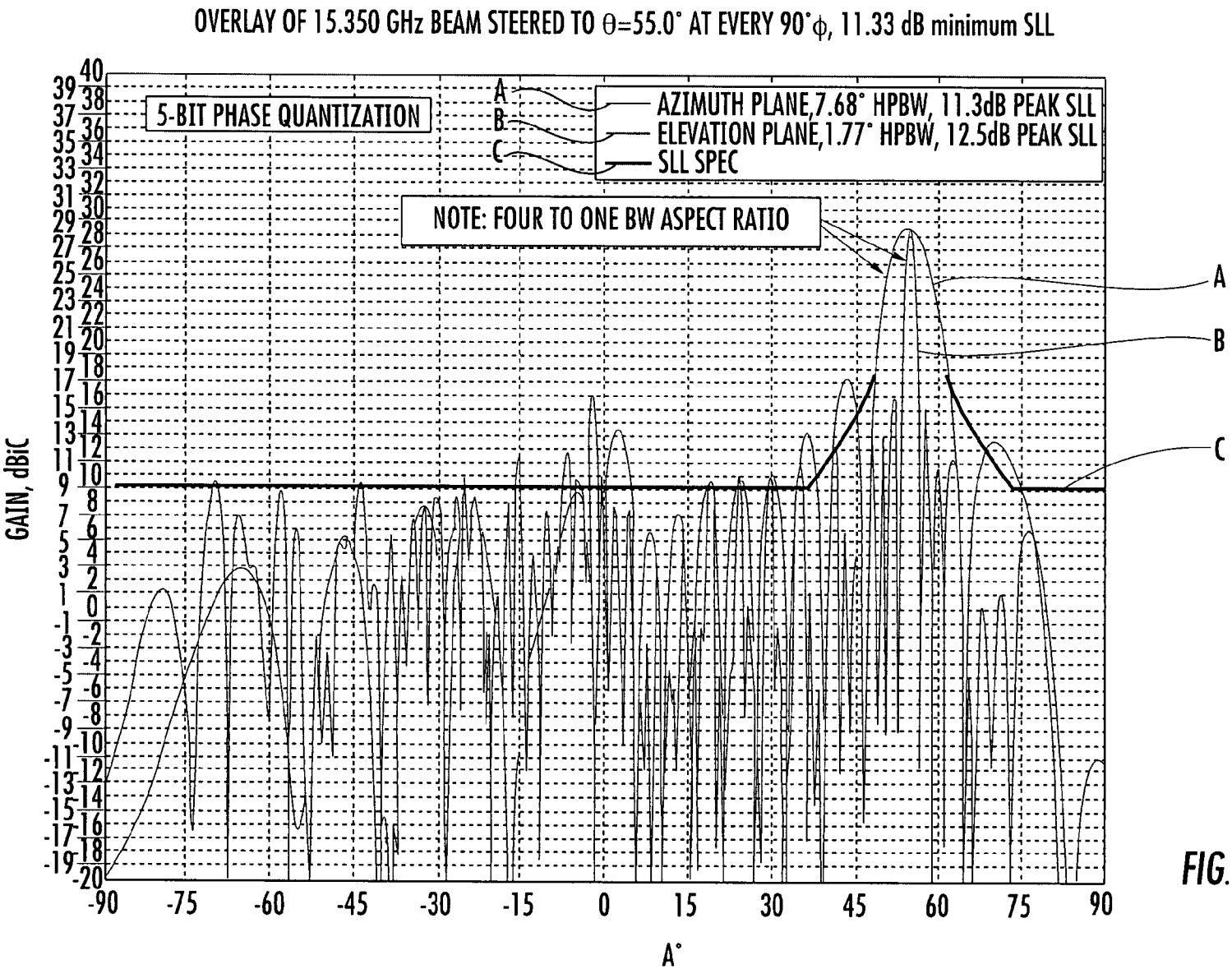
FIG. 7 is a graph showing a full transmit aperture scanned 55 degrees in principal planes at 15.35 GHz without errors, in accordance with an example of the present invention.

FIG. 7 shows a full transmit aperture scan 55 degrees in principal planes at 15.35 GHz without errors and showing an overlay of 15.350 GHz beam steered to 55 degrees at every 90 degrees and 11.33 decibels minimum stringent sidelobe level (SLL). The graph shows a 5-bit phase quantization and a four to one BW aspect ratio.

Figure 8:
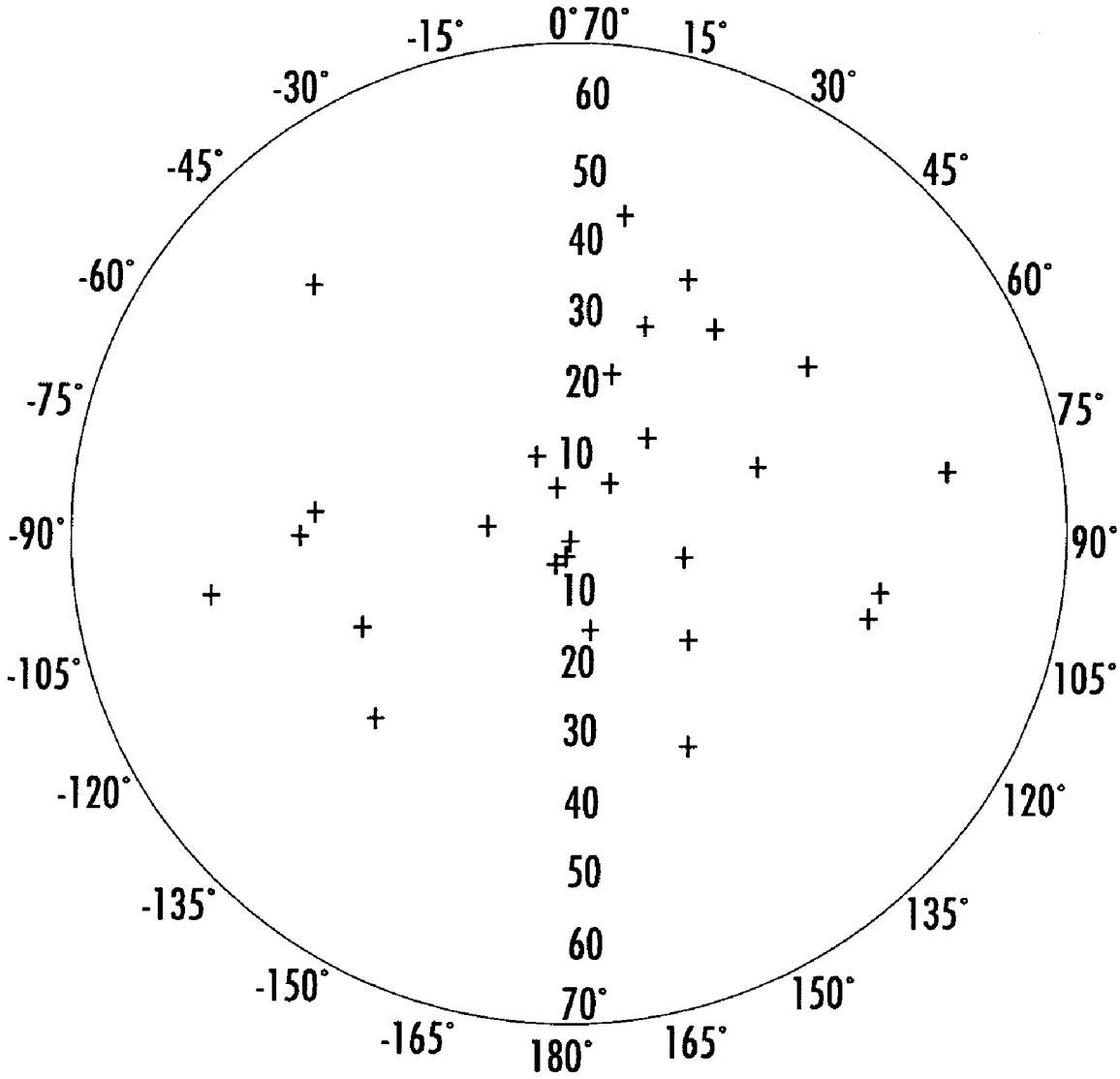
FIG. 8 is a graph showing a full transmit aperture, sidelobe level (SLL) compliance and Monte Carlo beam locations, in accordance with an example of the present invention.

FIG. 8 shows a full transmit aperture SSL compliance and Monte Carlo beam locations. A Monte Carlo simulation can use a random number generator to model a series of events when it is uncertain whether or not a particular event will occur. The probability of occurrence can be estimated. Large processors can be used to number possible models under study and can be mathematically constructed from constituents selected at random from representative populations. The simulation can correspond to any procedure that involves statistical sampling techniques to obtain approximate solution to a mathematical or physical problem as illustrated with the phase array antenna as described.

The graph in FIG. 8 shows a 96.2% SSL compliance/0.013 decibel peak beam shaped ripple for the 30 random main beam locations as illustrated. The uniform random variables for each trial had a frequency of 15.3175 GHz±32.5 MHz, and a main beam θ location at 0 degrees ϕ360 degrees. Normal random variables for each trial were as element RMS with amplitude/phase errors=1 dB/13.2 degrees. 5-bit phase quantization, element beam steering phases computed at 15.3175 GHz, and 96.2% SLL compliance vs. requirement for 90%.

Figure 9:
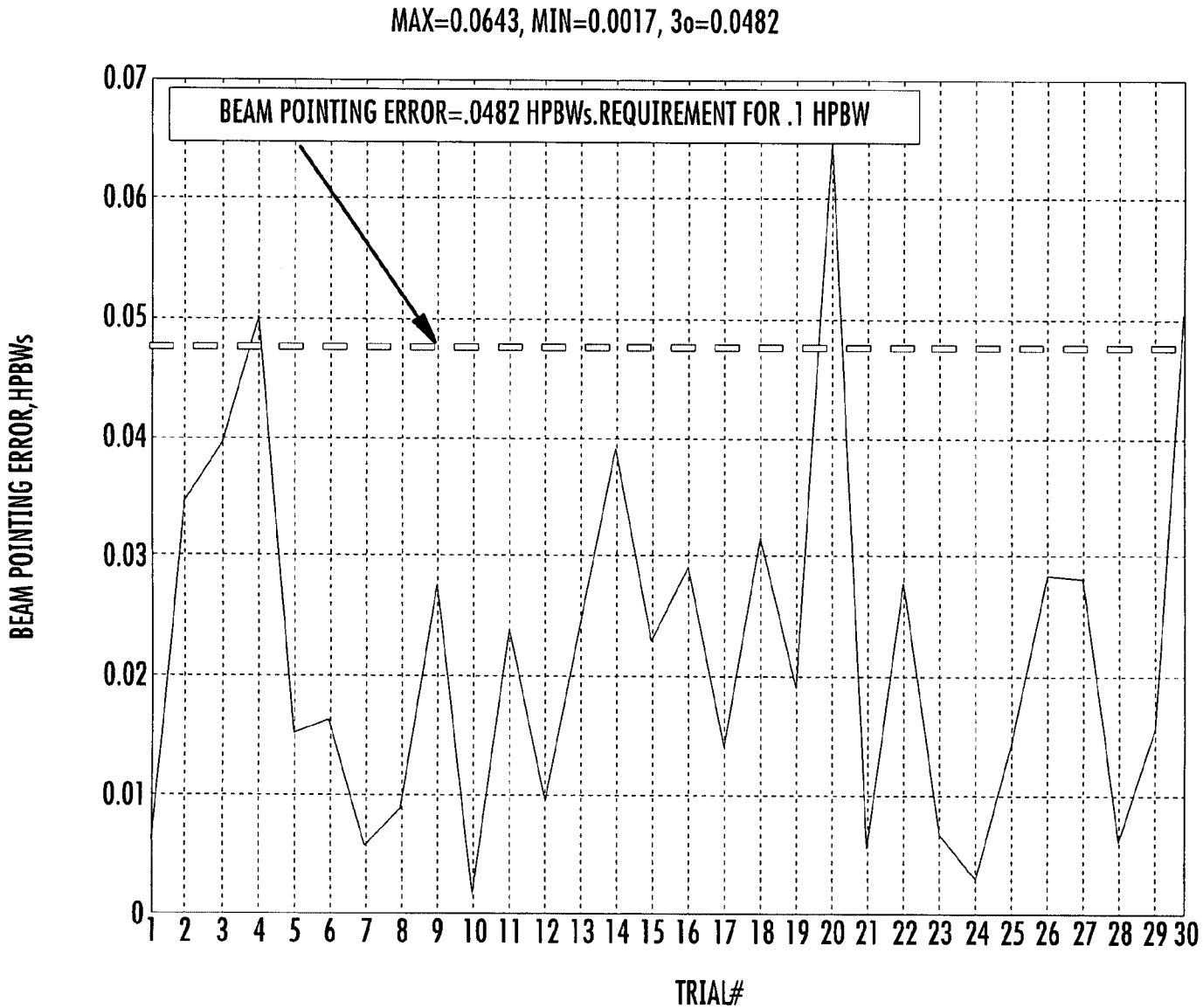
FIG. 9 is a graph showing a full transmit aperture beam pointing error, in accordance with an example of the present invention.

FIG. 9 is a graph showing a full transmit aperture beam pointing error that is about 0.482 HPBW versus a requirement for 0.1 HPBW. The beam pointing error is shown on the vertical left and trial numbers shown on the horizontal. A maximum of 0.0643 a minimum of 0.0017 is illustrated.

Figure 10:
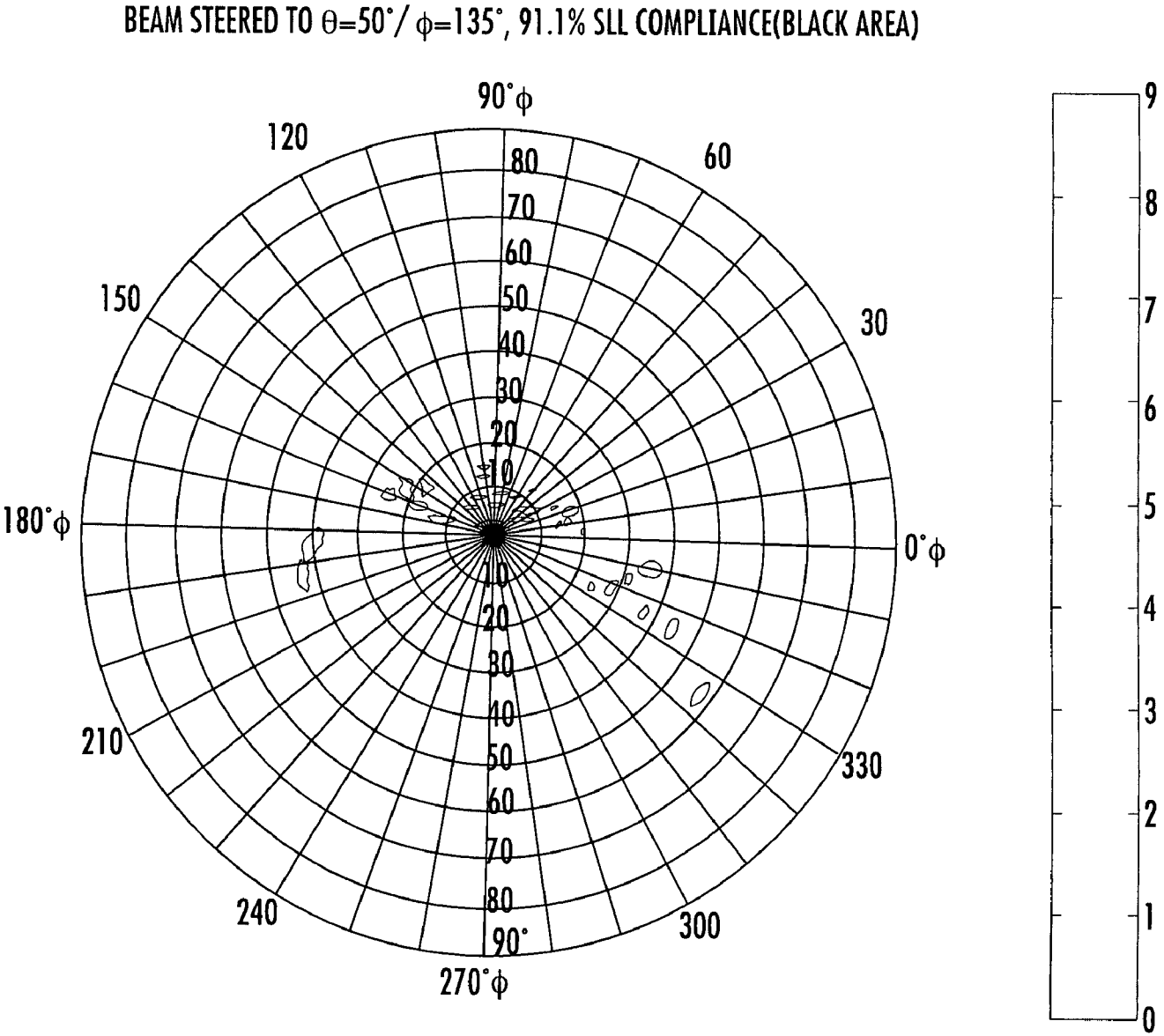
FIG. 10 is a graph showing a full transmit aperture with the worst case Monte Carlo SLL compliance, in accordance with an example of the present invention.

FIG. 10 is a graph showing a full transmit aperture worse case Monte Carlo SLL compliance showing a beam steered as illustrated.

Figure 11:
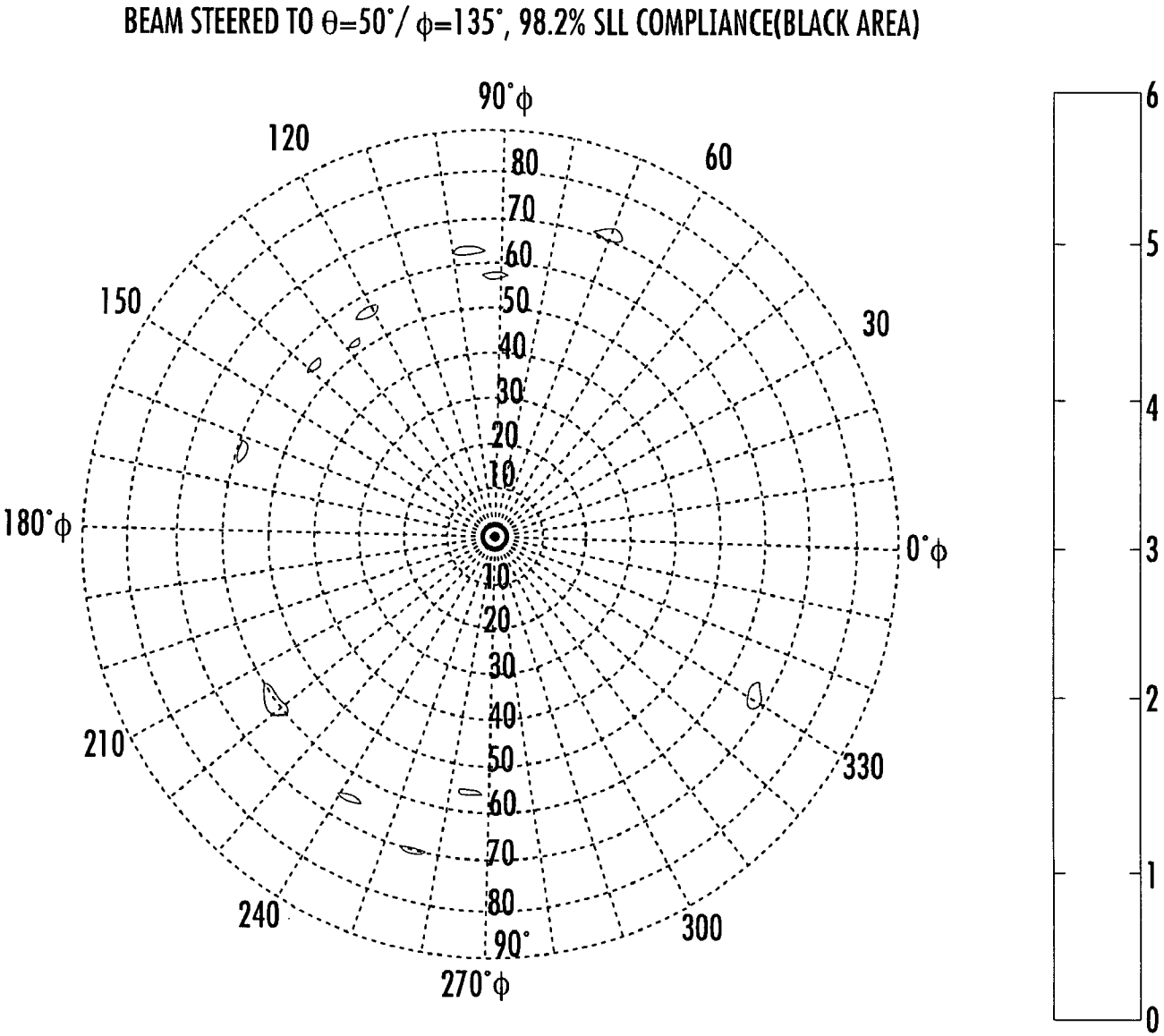
FIG. 11 is a graph showing a full transmit aperture best case Monte Carlo SLL compliance, in accordance with an aspect of the present invention.

FIG. 11 is a graph showing a full transmit aperture best case Monte Carlo SLL compliance with a beam steered as illustrated.

Figure 12:
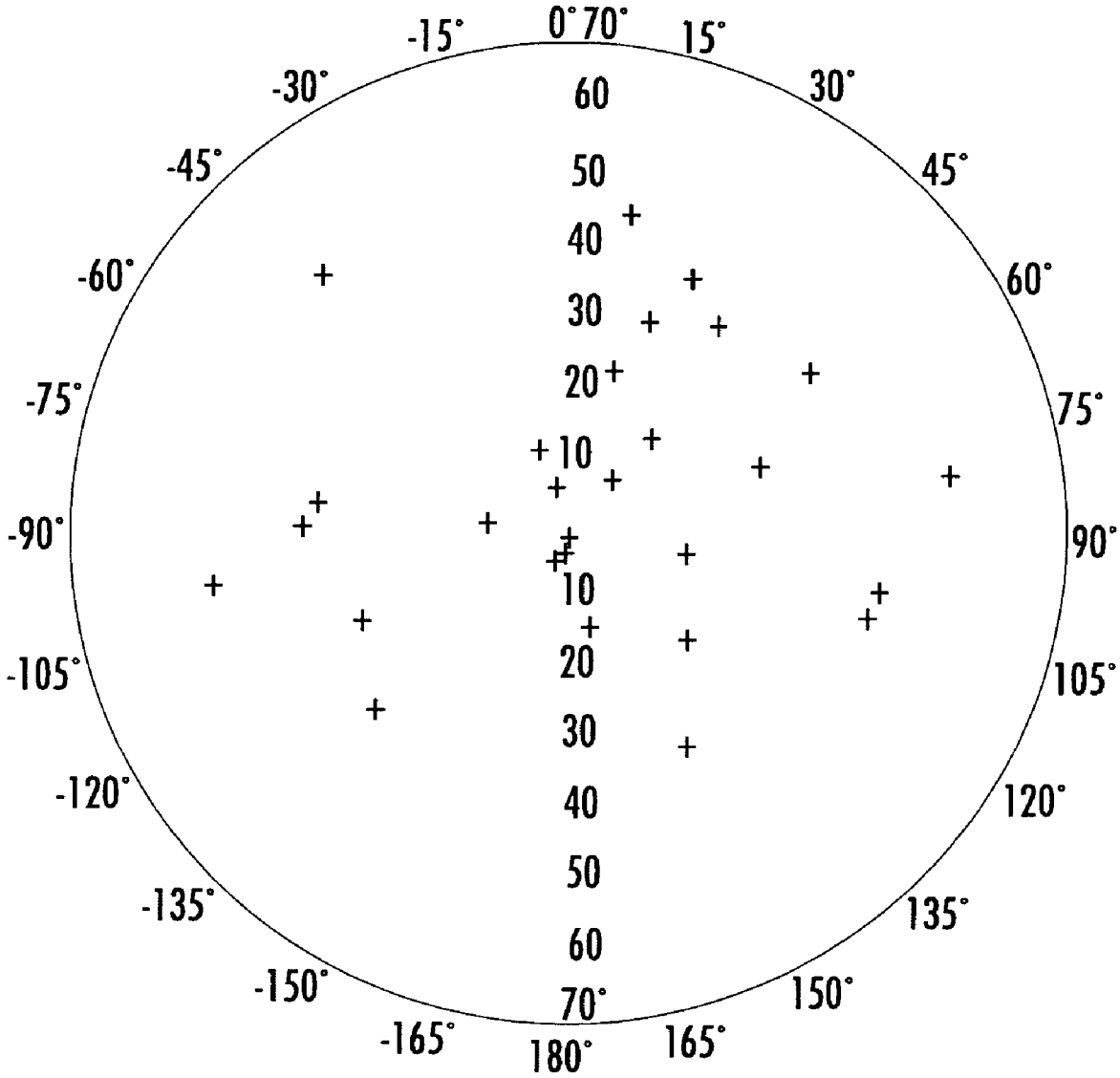
FIG. 12 is a graph showing a one-quarter transmit aperture with SLL compliance and Monte Carlo beam locations, in accordance with an example of the invention.

FIG. 12 is a graph showing a one-quarter transmit aperture SLL compliance and Monte Carlo beam locations. Uniform random variables for each trial frequency at 15.3175 GHz±32.5 MHz, main beam θ location of 0 degrees θ and 55 percent, and main beam ϕ location of 0 degrees and ϕ360 degrees. The normal random variables for each trial include an element RMS having amplitude/phase errors=1 dB/13.2 degrees. 5-bit phase quantization, and element beam steering phases computed at 15.3175 GHz.

Figure 13:
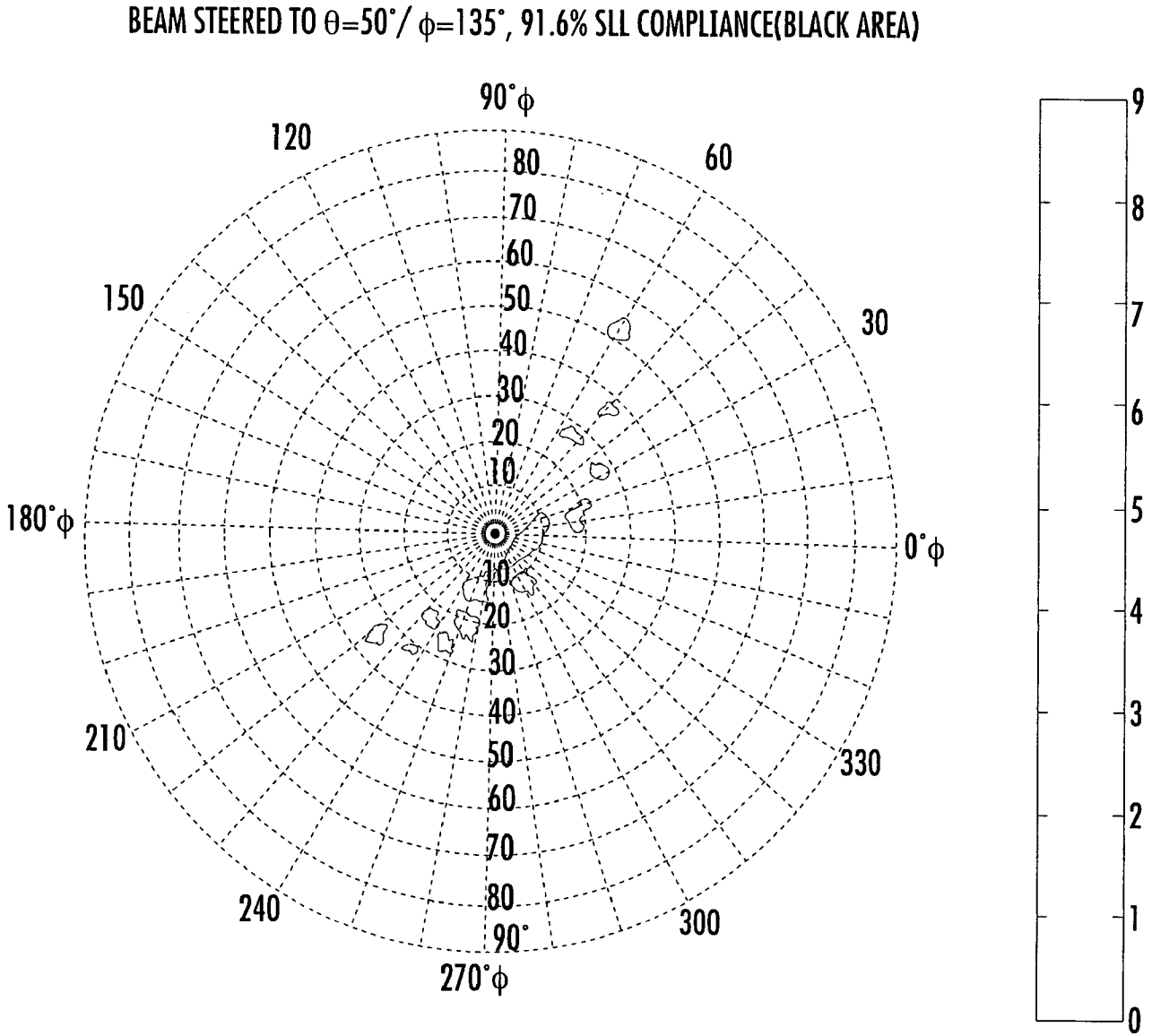
FIG. 13 is a graph showing a one-quarter transmit aperture with a worst case Monte Carlo SLL compliance, in accordance with an example of the present invention.
Figure 14:
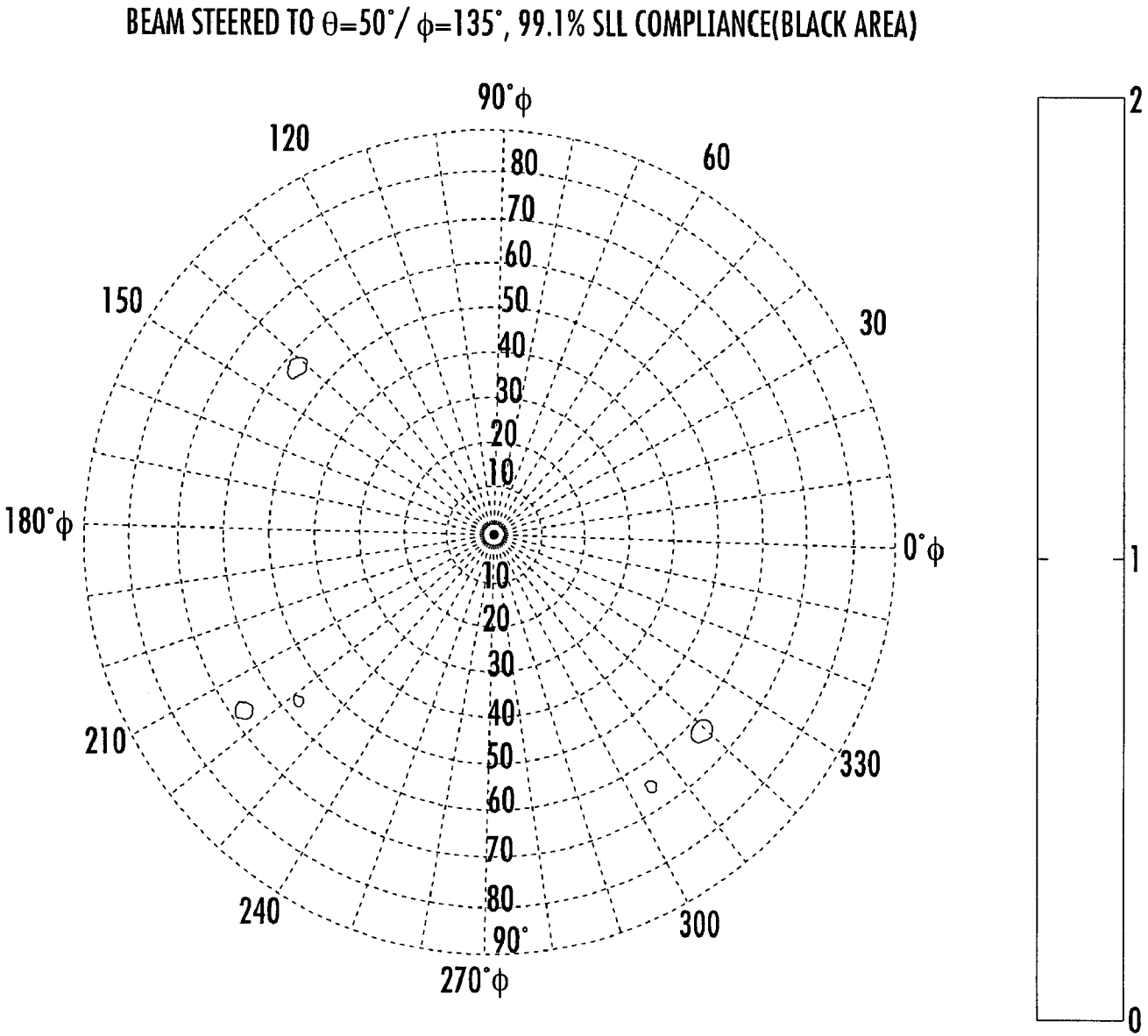
FIG. 14 is a graph showing a one-quarter transmit aperture best case Monte Carlo SLL compliance, in accordance with an example of the present invention.

FIG. 13 is a graph showing a one-quarter transmit aperture worse case Monte Carlo SLL compliance with a beam steered as illustrated. A best case Monte Carlo SSL compliance, on the other hand, is shown in FIG. 14 with a beam steered as illustrated.

Figure 15:
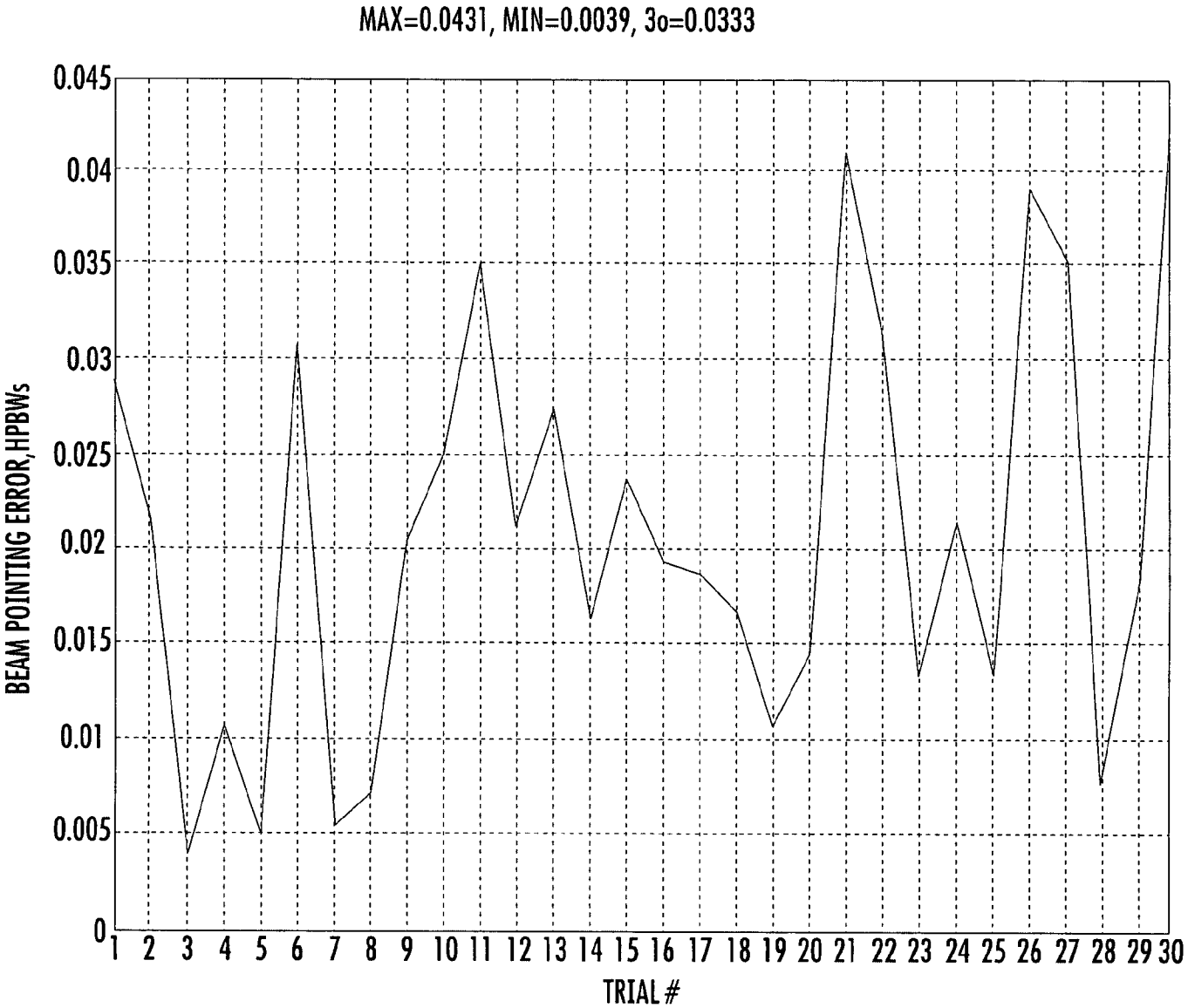
FIG. 15 is a graph showing a one-quarter transmit aperture beam pointing error, in accordance with an example of the present invention.
Figure 16:
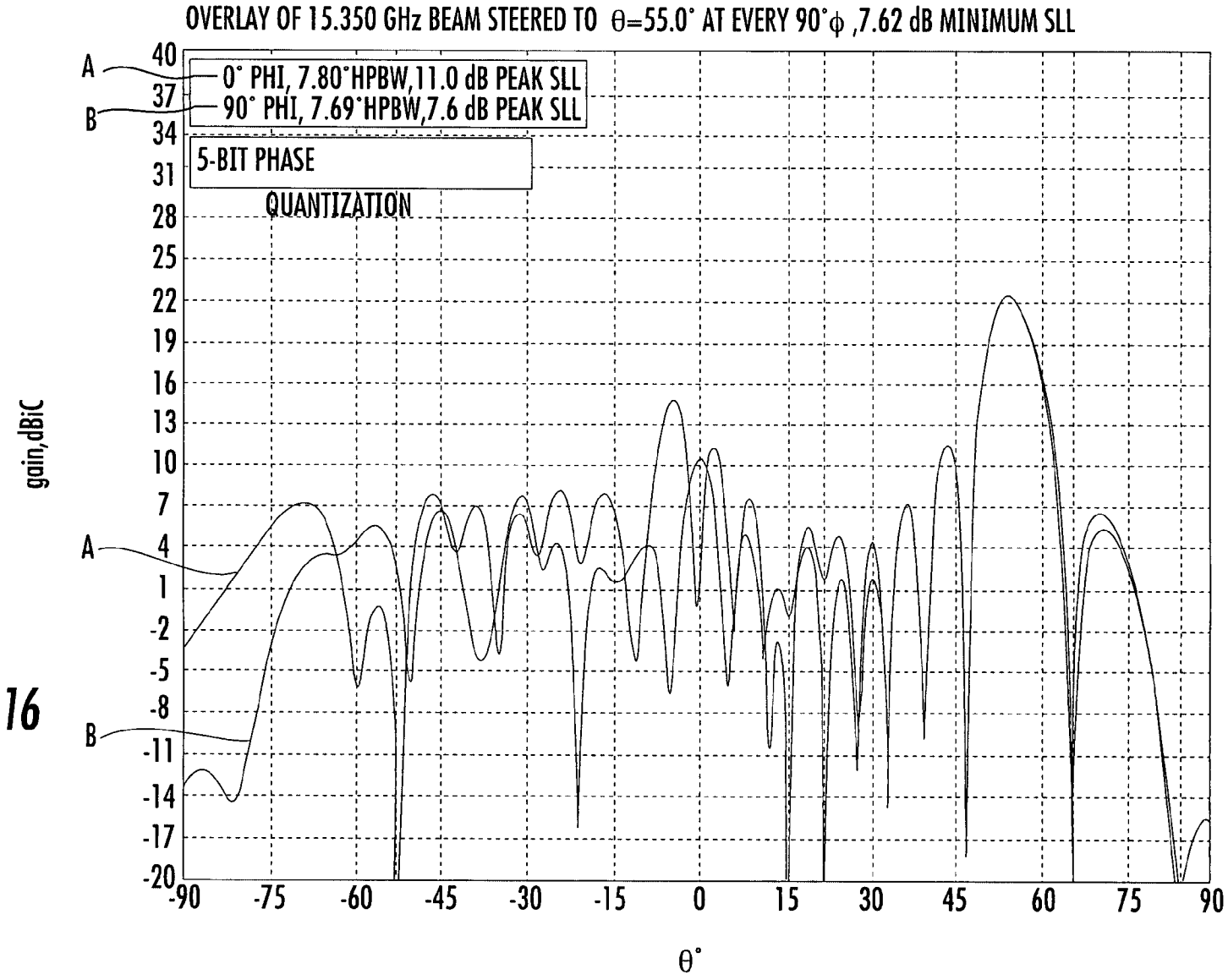
FIG. 16 is a graph showing a one-quarter transmit aperture scanned 55 degrees in principal planes at 15.35 GHz without errors, in accordance with an example of the present invention.

FIG. 15 is a graph showing a one-quarter transmit aperture beam pointing error and FIG. 6 is a graph showing a one-quarter transmit aperture scan 55 degrees and principal planes at 15.35 GHz without errors as showing 5-bit phase quantization. Normal random variables for each trial were as element RMS with amplitude/phase errors=1 dB/13.2 degrees.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a plurality of subarray lattices, each subarray lattice comprising a plurality of antenna elements arranged in an aperiodic, spiral configuration and each connected together serially in a linear configuration and forming a substantially rectangular aperture of a phased array antenna, wherein each subarray lattice is clocked progressively relative to an adjacent subarray lattice to obtain an aperiodic aperture and reduce grating lobes.

2. A phased array antenna according to claim 1, wherein said aperture has a beam that is greater in azimuth than in elevation.

3. A phased array antenna according to claim 1, wherein said aperture has a beam that has about a four to one aspect ratio.

4. A phased array antenna according to claim 1, wherein said aperture has a beam that is about two degrees in elevation by about eight degrees in azimuth.

5. A phased array antenna according to claim 1, and further comprising four subarray lattices clocked progressively about 90 degrees.

6. A phased array antenna according to claim 1, wherein said aperture forms eight beams, with each subarray lattice forming two beams simultaneously.

7. A phased array antenna according to claim 1, wherein said antenna elements are spaced from each other greater than about one-half wavelength of a transmitted or received signal.

8. A phased array antenna according to claim 1, wherein each subarray lattice is formed substantially identical to each other.

9. A phased array antenna comprising:

a circuit board;

a plurality of antenna elements on said circuit board and arranged into a plurality of subarray lattices, each subarray lattice comprising a plurality of antenna elements arranged in an aperiodic, spiral configuration and each connected together serially in a linear configuration and forming a substantially rectangular aperture of a phased array lattice; and electronic circuitry supported by said circuit board and operatively connected to said antenna elements for amplifying, phase shifting and beam forming any transmitted and received signals, wherein each subarray lattice is clocked progressively relative to an adjacent subarray lattice to obtain an aperiodic aperture and reduce grating lobes.

10. A phased array antenna according to claim 9, and further comprising an antenna support member that supports said circuit board.

11. A phased array antenna according to claim 9, wherein said aperture has a beam that is greater in azimuth than in elevation.

12. A phased array antenna according to claim 9, wherein said aperture has a beam that has about a four to one aspect ratio.

13. A phased array antenna according to claim 9, wherein said aperture has a beam that is about two degrees in elevation by about eight degrees in azimuth.

14. A phased array antenna according to claim 9, and further comprising four subarray lattices clocked progressively about 90 degrees.

15. A phased array antenna according to claim 9, wherein said aperture forms eight beams, with each subarray lattice forming two beams simultaneously.

16. A phased array antenna according to claim 9, wherein said antenna elements are spaced from each other greater than about one-half wavelength of a transmitted or received signal.

17. A phased array antenna according to claim 9, wherein each subarray lattice is formed substantially identical to each other.

18. A phased array antenna comprising:

a multilayer circuit board;

a plurality of antenna elements on said multilayer circuit board and arranged into a plurality of subarray lattices, each subarray lattice comprising a plurality of antenna elements arranged in an aperiodic, spiral. configuration and each in a linear configuration and forming a substantially rectangular aperture of a phased array antenna; and electronic circuitry supported by said multilayer circuit board and operatively connected to said antenna elements for amplifying, phase shifting and beam forming any transmitted and received signals, wherein each subarray lattice is clocked progressively relative to an adjacent subarray lattice to obtain an aperiodic aperture and reduce grating lobes.

19. A phased array antenna according to claim 18, and further comprising an antenna support member that supports said circuit board.

20. A phased array antenna according to claim 18, wherein said multilayer circuit board comprises green tape layers.

21. A phased array antenna according to claim 18, and further comprising electronic circuitry mounted between said antenna elements.

* * * * *